United States Patent [19]

Chan

[11] Patent Number: 5,032,099

[45] Date of Patent: Jul. 16, 1991

[54] TOY MUSICAL BOX

[75] Inventor: Alex Chan, Kowloon, Hong Kong

[73] Assignee: Blue Box Toy Factory, Hong Kong

[21] Appl. No.: 591,282

[22] Filed: Oct. 1, 1990

[30] Foreign Application Priority Data

Oct. 2, 1989 [GB] United Kingdom ..... 8922140

[51] Int. Cl.[5] ..... A63H 30/00; A63H 33/04; A63H 3/52; B41J 11/38

[52] U.S. Cl. ..... 446/175; 446/85; 446/404; 446/408; 40/472; 40/457; 40/347

[58] Field of Search ..... 446/81, 175, 149, 150, 446/151, 82, 397, 404, 405, 406, 408, 409, 484, 485, 219; 40/472, 347, 457

[56] References Cited

U.S. PATENT DOCUMENTS

| | | | |
|---|---|---|---|
| 2,003,765 | 6/1935 | Widen | 446/175 |
| 2,064,115 | 12/1936 | Holsman | 40/472 |
| 2,102,243 | 12/1937 | Van Deventer et al. | 40/472 X |
| 2,608,778 | 9/1952 | O'Gorman | 40/472 |
| 3,114,216 | 12/1963 | Crawford et al. | 446/408 X |
| 3,388,499 | 6/1968 | Mercorelli | 446/408 |
| 3,458,950 | 8/1969 | Tomaro | 446/175 |
| 3,590,525 | 6/1971 | Tomaro | 446/408 |
| 3,882,620 | 5/1975 | Grindle | 40/347 X |
| 4,637,007 | 1/1987 | Sakurai | 446/175 X |
| 4,873,286 | 11/1990 | Davison | 446/175 |

*Primary Examiner*—Robert A. Hafer
*Assistant Examiner*—D. Neal Muir
*Attorney, Agent, or Firm*—Pollock, Vande Sande & Priddy

[57] ABSTRACT

A toy musical box having an electronic musical sound reproduction circuit and an electric motor drive for an endless band carrying a continuous picture past a window, so that the musical box can resemble a television set. The operation of the sound reproduction circuit and the motor are remotely controlled by sound impulses from a separate hand-held device, the musical box having a microphone and a discriminator to provide an output signal upon receipt of the sound impulses. Preferably a double sound impulse is acquired to operate the musical box, eg. two clicks one immediately following the other, for differentiation from other extraneous sounds.

5 Claims, 3 Drawing Sheets

TOY MUSICAL BOX

This invention relates to a toy musical box.

BACKGROUND TO THE INVENTION

Such musical boxes are well known and tend to comprise a mechanical drive from a clockwork spring and sounds are produced by providing a number of pegs on a drum, which is rotated by the drive, the pegs engaging one of a series of small tuned reeds as the drum rotates past the end of the reeds. It is also known to associate with such musical boxes a picture on an endless band which, simultaneously with the production of music, is moved past a window in the casing for the musical box to provide a form of moving picture.

In toys of this type the outer casing often resembles a television set so that the child playing with the toy can see a moving picture and hear sounds emitted from the musical box itself, so simulating the watching of a real television set.

It is an object of the present invention to enhance the play value of such a musical box so as to make it simulate more closely a remote control television set.

BRIEF SUMMARY OF THE INVENTION

According to the invention there is provided a toy musical box comprising an electronic musical sound reproduction circuit which, when energized and its output fed to a loudspeaker, will reproduce a tune, a loudspeaker to reproduce the output from the circuit, an electric motor drive for advancing an endless band carrying a continuous picture past a window, a sound detector, a discriminator for detecting receipt of a particular sound impulse by the sound detector and producing an output signal upon receipt of that sound impulse, means for energizing the sound reproduction circuit and the electric motor upon receipt of the said signal, and means, separate from the toy musical box, for providing the said particular sound impulse when manually actuated.

With such an arrangement therefore the child can use the impulse sound producing means to control the operation of the toy musical box. Thus by actuating this and producing the required sound impulse, this will be received by the sound detector and the discriminator will provide an output signal to activate the arrangement. As a result the sound reproduction circuit will be energized and so will the motor to provide the moving picture.

The arrangement of the invention can include a timer so that after a certain preset time, such as for example one complete pass of the endless band or the completion of a particular tune, the energization of the motor and sound reproduction will stop automatically. Alternatively the first time that the sound impulse is provided, the musical box can be energized and a second time the sound output is provided it will be de-energized, and so on. Such an arrangement can include a detector circuit and an electronic switch. The detector circuit picks up the signal and turns on the electronic switch which maintains its "on" condition until the detector again picks up the trigger signal whereupon the electronic switch is reset to the "off" condition.

In one preferred embodiment of the invention, the means providing the required sound impulse actually provide two separate sounds in quick succession, eg. two clicks, one immediately after the other. This can be achieved, for example, by bending a shaped piece of metal which makes a first click when bent one way and a second similar click when released. Then it is advantageous for the toy musical box of the invention to have means to detect a double sound such as these, ie. two sound outputs repeated within a short period such as say 2 seconds, since this enables the discriminator to be relatively simple but yet not confused by extraneous sounds.

The sound reproduction circuit can produce a single tune or can easily be programmed to provide one of a plurality of tunes which can be played in a random or particular order.

BRIEF DESCRIPTION OF THE DRAWINGS

A toy musical box according to the invention will now be described, by way of example, with reference to the accompanying drawings, in which.

DESCRIPTION OF THE PREFERRED EMBODIMENT

Figure 1:
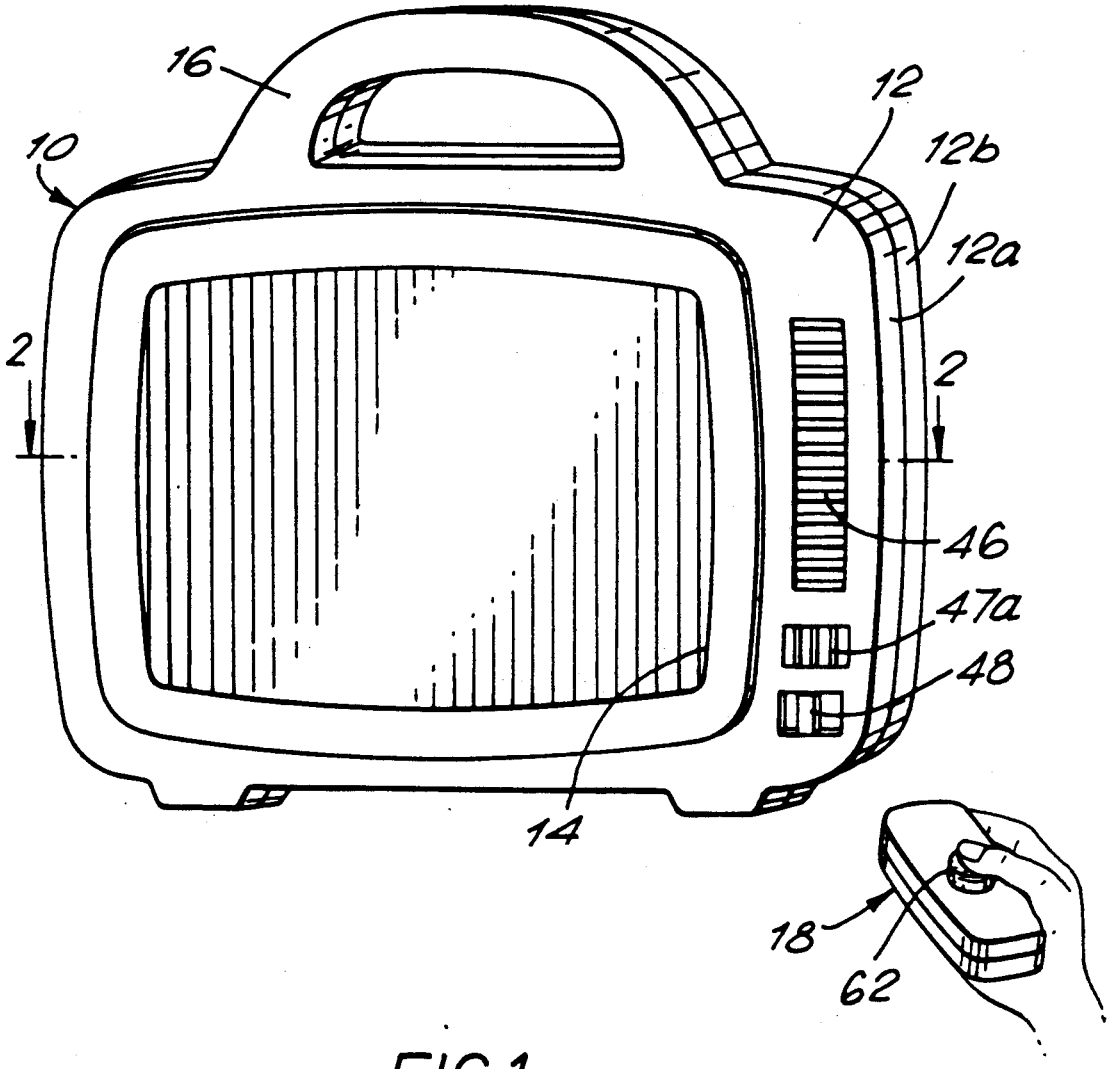
FIG. 1 is a front perspective view of the musical box.
Figure 2:
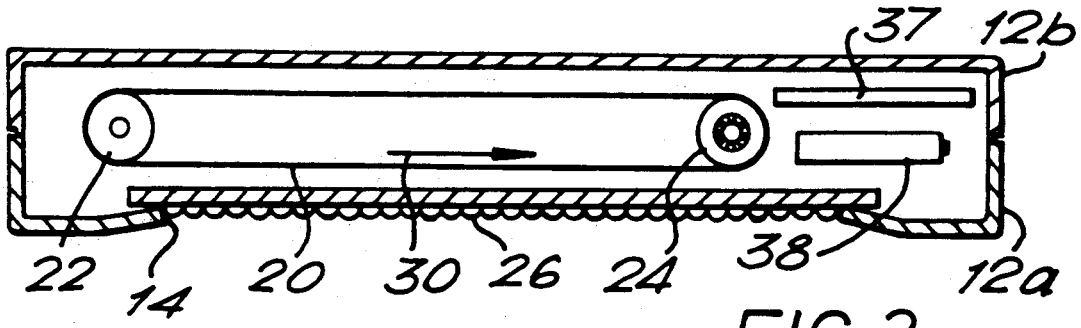
FIG. 2 is a section taken along the line 2—2 of FIG. 1.
Figure 3:
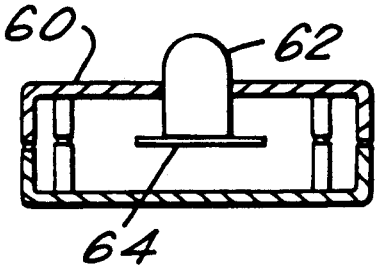
FIG. 3 is a section through the sound emitting device.
Figure 4:
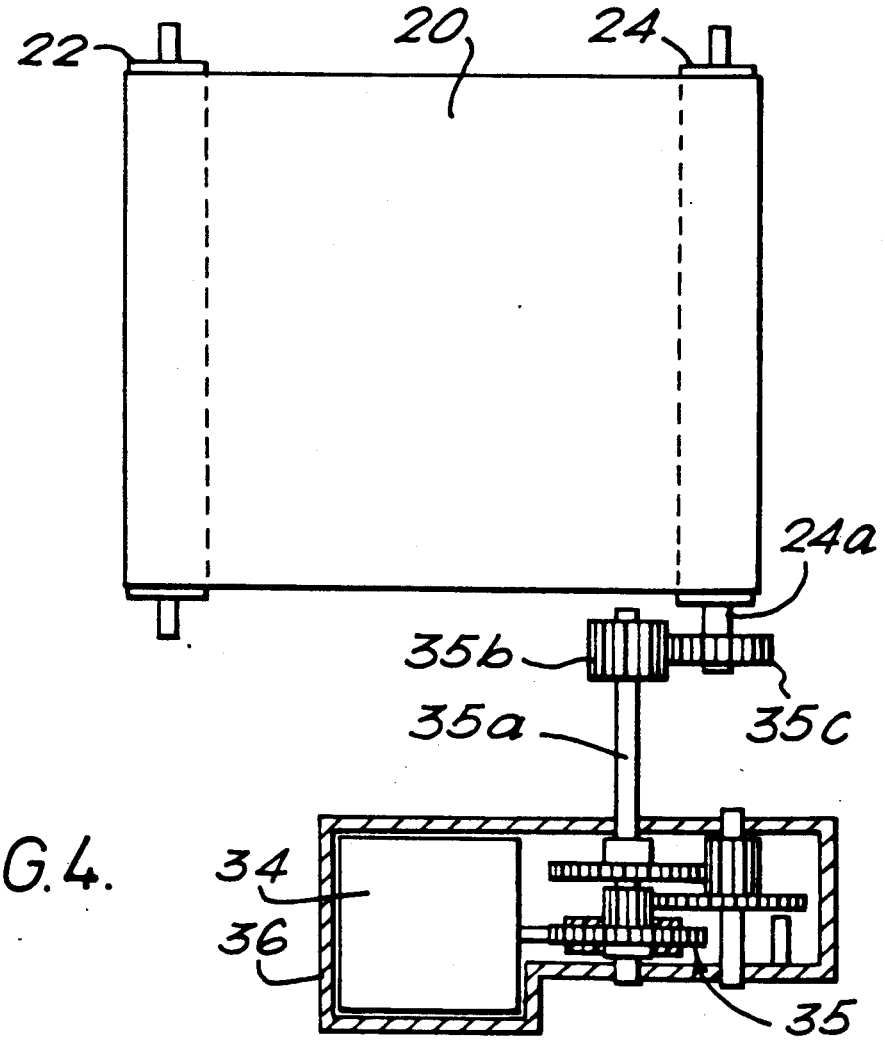
FIG. 4 is a diagram showing the arrangement for the moving of the picture.
Figure 5:
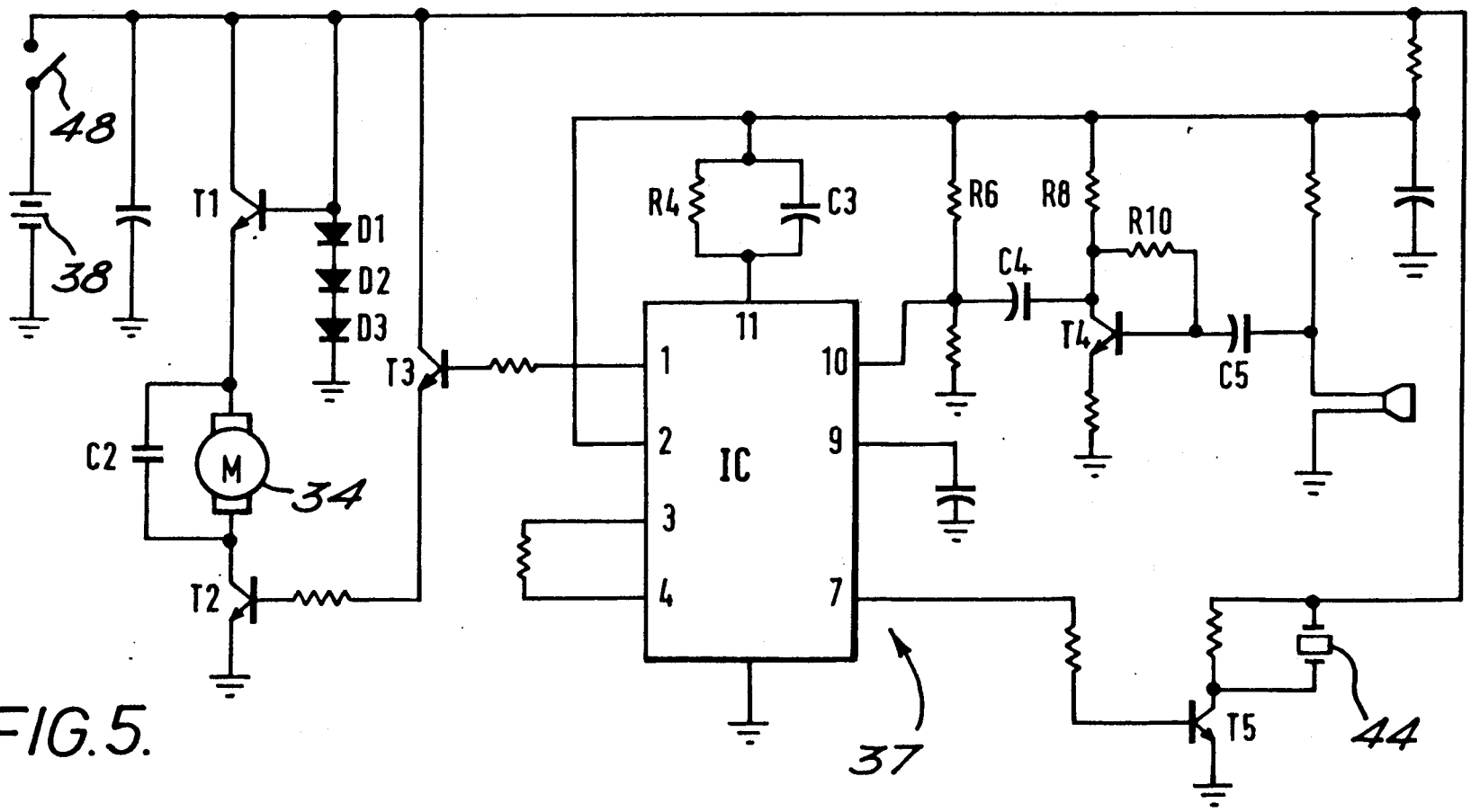
FIG. 5 is a circuit diagram showing the operation of the electrical circuitry within the musical box.

The toy musical box 10 according to the invention comprises an outer casing 12 shaped to resemble a portable television set. It includes an opening or window 14 in the front face thereof and an integrally formed handle 16 at the top. Also associated with the musical box 10 is a hand-held noise emitter 18 which will be described in due course.

The casing 12 is formed in two parts, a front portion 12*a* and a rear portion 12*b*. Within the casing 12 is positioned an endless band 20 which can be circulated round two rollers 22 and 24. The endless band 20 carries a picture which repeats itself and one portion of the band adjacent the window 14 moves past just beneath the window.

The window itself is covered with a transparent lenticular element 26, that is to say a covering having a large number of integrally formed small, upright, semi-cylindrical portions on the front face. As is well know these portions together with a special arrangement of the picture provide a kind of moving appearance to the picture as the band 20 is moved in the direction of the arrow 30 past the window. Such an arrangement is well known and is not believed to require further explanation.

In order to move the picture an electric motor 34 is provided and a gear reduction train 35 mounted in a chassis 36 rotates the roller 24 when the motor 34 is energized via an output shaft 35*a* and a pinion 35*b* mounted on that shaft and meshing with a pinion 35*c* mounted on a shaft 24*a* on which the roller 24 is mounted. The roller 22 is idly mounted within the frame 12.

Also positioned within the casing 12 is electronic circuitry 37 powered by storage batteries 38. These power the motor 34 via the circuitry 37 as will be described.

The circuitry 37 also provides an output to a piezo loudspeaker 44. The speaker 44 is mounted in the casing 12 so that it's sound can be emitted through a grill 46 on the front face. The sound reproducing signal is energized simultaneously with the motor 34.

A microphone 47 mounted behind a grill 47*a* in the front face of the casing detects actuating sounds as will be described.

The electronic circuitry 37 is powered by the batteries 38 via a manual on/off switch 48 mounted in the front face of the casing 12.

The operation of the motor 34 is controlled by transistors T1 and T2. Three diodes D1 to D3 provide a drop in the voltage from the batteries 38 to drop the voltage to one suitable to power the motor 34 in a steady fashion via the transistor T1. The transistor T2 is normally "off" but can be turned "on" by the output on pin 1 from a chip IC as will be described via a transistor T3. Thus, the output on pin 1 is normally low, so biasing the transistor T3 "off", but when the output goes "high", then transistor T3 becomes conductive and so in turn does transistor T2, which now allows the motor to be energized.

The chip IC is programmed to provide on pin 7 an output at the selected tunes when the motor 34 is energized in the form of an frequency signal to generate one or more known tunes. When such a signal is provided on pin 7, this is amplified by a transistor T5 to provide an output to power the loudspeaker 44 and so provide an audible sound output.

The microphone 47 provides an output signal which passes to a capacitor C5 attached to the base of a transistor T4. Transistor T4 is normally biased by resistors R8 and R10 to be "off". The value of capacitor C5 is selected to be quite small so that relatively high frequency signals corresponding to high frequency sounds will pass to the base of transistor T4. As a result when microphone 47 picks up a high frequency click, transistor T4 will momentarily become conductive.

Under normal circumstances capacitor C4 is charged. However, when transistor T4 conducts, it is suddenly discharged and its output, which is connected to pin 10 of the chip IC, goes low for a short pulse until it is again charged via resistor R6. Therefore receipt of a high frequency chick by microphone 47, gives a low pulse on pin 10.

Connected to pin 11 of the chip IC is a time constant circuit composed of capacitor C3 and resistor R4. When pin 10 goes low, pin 11 becomes conductive to discharge capacitor C3. Thereafter, the capacitor C3 recharges over a short pre-set period of time, that is say 1 to 3 seconds, and preferably about 2 seconds. The program in the chip IC is set so that, until the capacitor C3 is recharged sufficiently, i.e. the voltage on pin 11 again becomes "high", receipt of a second low pulse on pin 10 will actuate the chip IC to energize the motor 34 and loudspeaker 44. However, if a second pulse on the pin 10, i.e. a second click received by the microphone 47, is not received before the capacitor C3 becomes recharged, then the chip IC will not activate the motor 34 and loudspeaker 44. Thus, there must be two clicks within a short period of time to activate the toy musical box 10. In this way, the discriminator formed by the capacitor C5 can be very simple, yet ordinary stray sounds will in general not activate the toy musical box.

Once a double low pulse is received on pin 10 within the said short period, the chip IC provides a high output on pin 1 to energize the motor 34 and a sound frequency signal on pin 7 to cause the loudspeaker 44 to give an audible output. This continues indefinitely, until a double low pulse is again received on pin 10. Thus, the next receipt of a double low pulse within the short period, will cause the output on pin 1 to go low, so deactivating the motor 34 and inhibiting the output on pin 7 so stopping the sound output.

The circuitry 37 is then ready to start the operation of the box 10 when a fresh double click is received by the microphone 47.

The operation of the circuit 37 is controlled by means of the noise emitter 18. This comprises a hand-held outer casing 60, with a press button 62. The button bears against a length of metal strip 64 which is shaped to snap suddenly from one position to another when pressed sufficiently hard and which emits a first loud click when depressed firmly by pressure on the button 62 and a second similar loud click when released.

As explained above, the circuit 37 is arranged to detect the noise of those loud clicks so that when the child presses and immediately released the button 62, a double click sound is produced and received by the microphone 47 so starting the operation of the motor 34 to move the picture past the window 14 and to produce the sound from the speaker 44. When the child again presses and quickly releases the button 62 and produces the next pair of loud clicks, the operation of the toy musical box 10 is halted. The device 18 therefore acts in a similar way to a remote control unit for a conventional television set.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A toy musical box comprising:

an electronic musical sound reproduction circuit having an output;

a loudspeaker to which said output is directed to reproduce a tune;

an endless band carrying a continuous picture;

a casing for said musical box;

a window in said casing, a part of said band being positioned adjacent said window so as to be visible therethrough;

electric motor drive means for circulating said band past said window;

a sound detector;

a discriminator for detecting receipt of a particular sound impulse by said sound detector and producing an output signal upon receipt of that sound impulse; means for energizing said sound reproduction circuit and said electric motor upon receipt of the said signal; and means, separate from the toy musical box, for providing the said particular sound impulse when manually actuated.

2. A toy musical box according to claim 1 which further includes a timer so that after a certain preset time the energization of said motor and sound reproduction circuit will stop automatically.

3. A toy musical box according to claim 1 in which a first time that the sound impulse is provided, the musical box is energized and a second time the sound output is provided it will be de-energized, and so on.

4. A toy musical box according to claim 3 which further comprises a detector circuit and an electronic switch, said detector circuit picking up the signal and turning on the electronic switch which maintains its "on" condition until the detector again picks up the trigger signal whereupon the electronic switch is reset to the "off" condition.

5. A toy musical box according to claim 1 in which the means providing the required sound impulse provide two separate sounds one immediately after the other, and the discriminator is arranged to detect the double sound.

* * * * *